United States Patent [19]

Voegeli

[11] Patent Number: 4,720,004

[45] Date of Patent: Jan. 19, 1988

[54] COIN-OPERATED DISPLAY RACK HAVING ROTATABLE COIN-RECEIVING MECHANISM WHICH ACTIVATES A MOVABLE COIN DIVERTER

[76] Inventor: Ronald C. Voegeli, 918 Gibbs Rd., Venice, Fla. 33595

[21] Appl. No.: 817,089

[22] Filed: Jan. 8, 1986

[51] Int. Cl.[4] ..... G07F 5/02

[52] U.S. Cl. ..... 194/202; 194/233; 194/248; 194/346; 194/350; 49/261; 49/394; 221/154; 292/223; 16/363

[58] Field of Search ..... 194/202, 232, 233, 247, 194/248, 345, 346, 350, 344; 221/154, 155, 243, 282; 49/261, 394; 312/138 R, 326, 327, 328; 70/144, 145; 292/217, 223; 126/194; 16/262, 266, 352, 363

[56] References Cited

U.S. PATENT DOCUMENTS

| | | | |
|---|---|---|---|
| 2,805,661 | 9/1957 | Pollock | 126/194 |
| 2,837,363 | 6/1958 | Eichner | 292/217 |
| 3,503,482 | 3/1970 | Davis | 194/233 |
| 3,712,441 | 1/1973 | Taylor | 194/233 |
| 3,760,923 | 9/1973 | Voegeli | 194/233 |
| 3,870,136 | 3/1975 | Voegeli | 194/247 |
| 3,941,227 | 3/1976 | Gordon | 194/232 X |
| 4,106,609 | 8/1978 | Kaspar | 194/247 |
| 4,371,072 | 2/1983 | Voegeli | 194/251 |
| 4,374,564 | 2/1983 | Miller et al. | 194/346 X |
| 4,375,844 | 3/1983 | Facto | 194/202 |
| 4,515,263 | 5/1985 | Facto | 194/346 |

*Primary Examiner*—Joseph J. Rolla
*Assistant Examiner*—Edward S. Ammeen
*Attorney, Agent, or Firm*—Burns, Doane, Swecker & Mathis

[57] ABSTRACT

A coin-operated latch mechanism for a newspaper rack includes a coin-receiving mechanism into which coins are deposited. A coin-return mechanism is provided which, when depressed, swings the coin-receiving mechanism to a position in which the outlets of the coin slots overly a coin-return diverter. The coin-return diverter is normally disposed in a coin return mode and is moved to a coin retention position in response to the opening of a door of the rack. A key-actuated wall of the rack is mounted on hinges which permit a simplified removal of the wall from the rack. The key-actuated wall includes a latch which enables the wall to be closed and relatched without the use of a key.

19 Claims, 17 Drawing Figures

Fig. 10
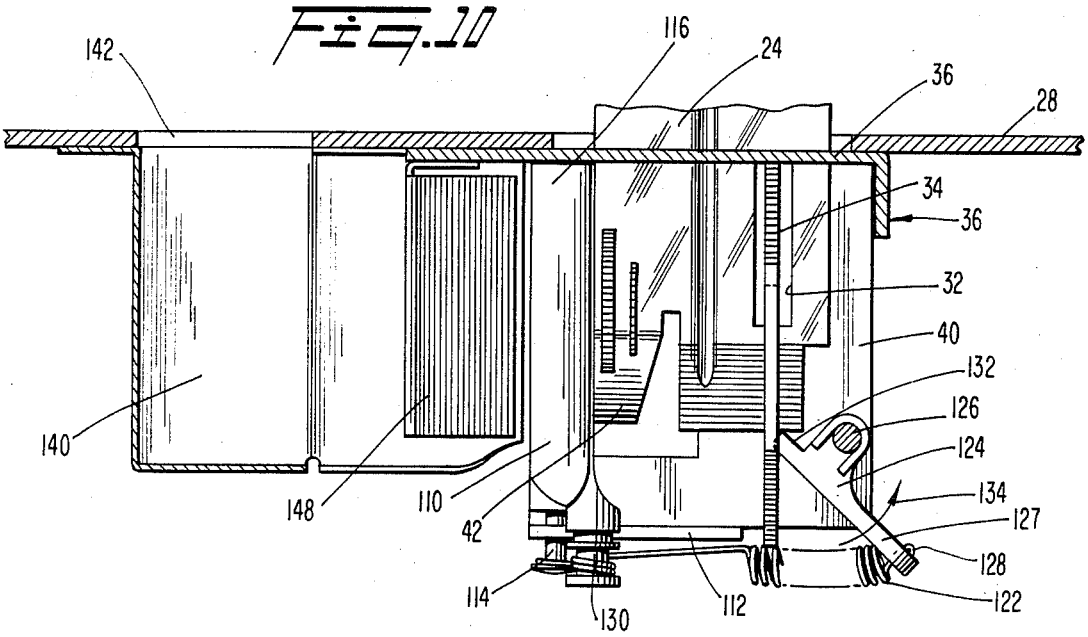
Fig. 11
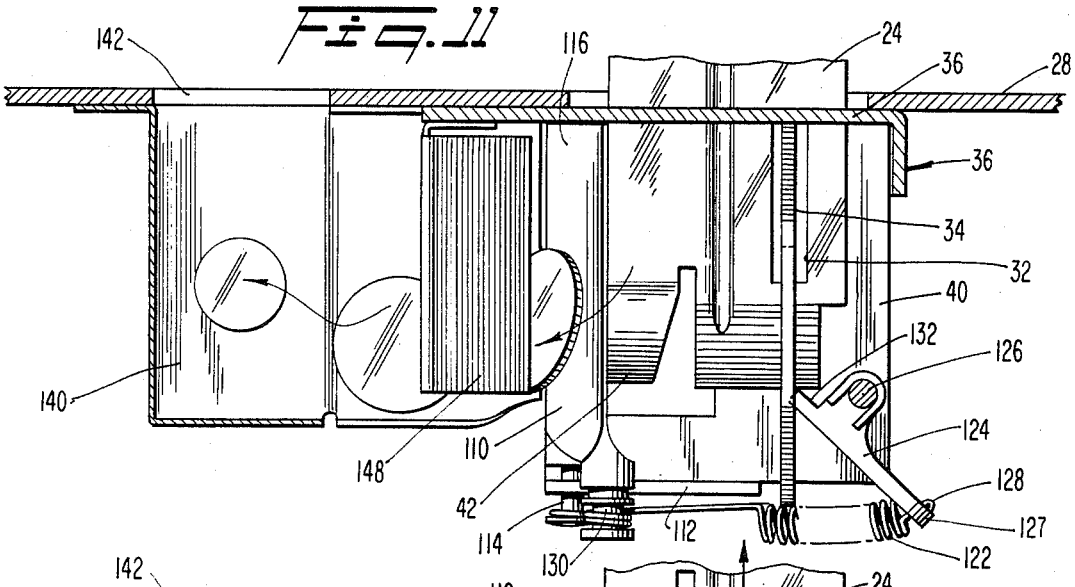
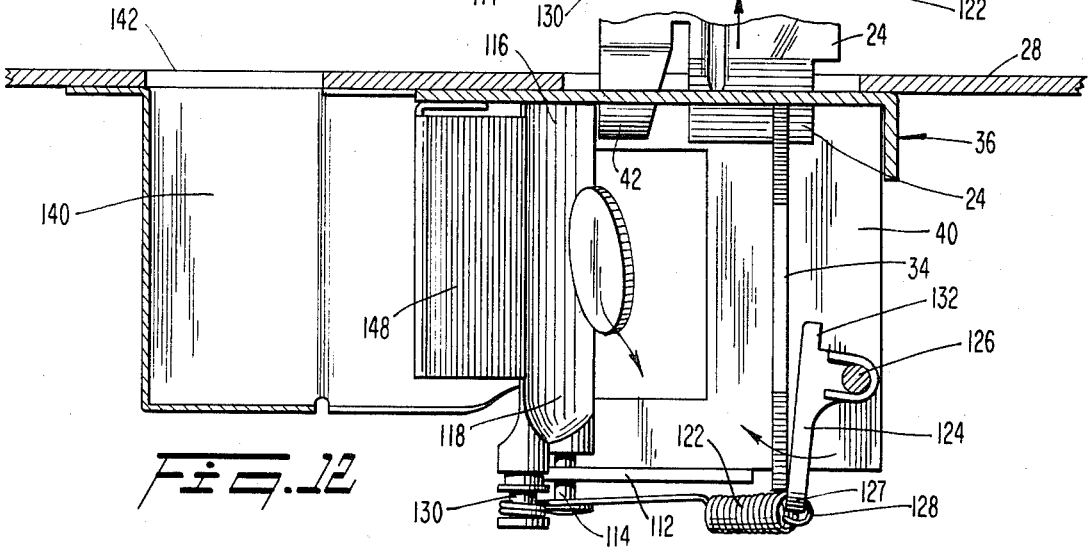
Fig. 12

COIN-OPERATED DISPLAY RACK HAVING ROTATABLE COIN-RECEIVING MECHANISM WHICH ACTIVATES A MOVABLE COIN DIVERTER

BACKGROUND AND OBJECTS OF THE INVENTION

The present invention relates to coin-operated latch mechanisms particularly adapted for use in newspaper display racks and the like.

Conventional coin-operated latch mechanisms are described in U.S. Pat. Nos. 3,760,923; 3,870,136; and 4,371,072, the disclosures of which are incorporated by reference herein. Each of those mechanisms discloses a coin-receiving member including a pair of channel members which define a plurality of vertical coin receiving slots. Coins which are dropped into the slots come to rest upon a latch which is carried by an access door of the display rack when the access door is in a closed position. If a prescribed number of coins are deposited into the slot(s), the lowermost coin functions to cam the latch downwardly in response to the door being pulled open, whereby the latch moves out of contact with a stop lug. After the door has been opened, the latch no longer underlies the coins, whereby the coins drop into a coin-collecting container located below the slots.

In the event that the customer desires to retrieve the deposited coins before the door has been opened, a coin return mechanism is provided having an actuator which is accessible to the customer. When the actuator is pushed, the following movements occur simultaneously: (i) the latch is pushed sideways against a spring bias so that the coins no longer rest thereupon, (ii) a coin chute is pushed into a position beneath the coins so that the coins which drop when no longer supported by the latch will be deflected by the diverter to a coin return ramp, and (iii) the channel members are swung apart to open-up the coin slots to facilitate the ability of the coins, especially skewed coins, to drop from the slots.

Although functioning successfully, room remains for improvement of the above-described mechanism. For example, it will be appreciated that in the performance of those steps, it is necessary to overcome a given amount of resistance produced by springs, friction, weight of parts, etc., which resistance can require considerable effort by the customer to push the actuator.

Furthermore, it might be possible for a customer, having knowledge of the manner in which the mechanism functions, to "cheat" the machine by obtaining a newspaper while also retrieving the deposited coinage. This might be accomplished by (i) depositing the proper coinage, (ii) pulling on the door just sufficiently to disengage the latch from its stop member, and (iii) pushing on the coin return actuator. If performed carefully, and in correct sequence, those steps might enable the door to be unlocked just as the coin return slot is positioned beneath the coins.

It is also possible that the sideways pushing of the latch during a coin return operation might impose sufficient torque to bend or otherwise damage the latch and/or its pivotal mounting.

The afore-described coin-operated unlatching mechanism is often mounted on a face plate or wall of the housing which can be swung open and closed for enabling the deposited coinage to be retrieved as well as enabling the mechanism to be maintained or repaired. It often occurs that repairs or maintenance can be simplified if the wall is removed and brought to a repair facility. Removal of the wall is difficult because it typically is mounted by hinges which are fastened to the wall and housing. Removal of the screws is time-consuming and difficult, especially if rusted.

Another shortcoming relating to the wall involves the fact that it is necessary to utilize a key to both unlock and lock the wall. That is, the wall itself usually includes a key-operated latching mechanism which is moved to its locking and unlocking positions by the manual rotation of a key. Generally, the key is kept on a chain secured to the operator's clothing and comprises one of numerous keys being carried. To unlock the wall, the operator (i) selects the proper key, (ii) unlocks the wall, (iii) removes the key, (iv) opens the wall, (v) performs the necessary functions, (vi) closes the wall, (vii) reselects the key, and (vii) relocks the wall. Since an operator typically services many such machines during a workday, it will be appreciated that the above steps, when considered together, and over the period of a day, involve a considerable amount of time to perform. Any reductions in the above steps would be welcomed in order to reduce the amount of time expanded.

It is, therefore, an object of the present invention to minimize or obviate problems of the type disclosed above.

An additional object is to provide a coin-operated latch mechanism in which the manual coin-release actuator offers less resistance to actuation.

A further object is to provide such a mechanism which resists being "cheated".

Yet another object is to provide such a mechanism in which the door latch is not susceptible to excessive sideward torque during a coin return operation.

A further object is to provide a key actuated face plate on a coin-operated display machine which is easily removable and which can be closed and locked without the use of a key.

SUMMARY OF THE INVENTION

These and other objects are achieved by the present invention which relates to a coin-operated display rack. The rack comprises a housing for containing articles to be displayed. A door is provided on the housing, the door including a latch receivable within the housing. A coinoperated device is disposed in the housing for releasably locking the latch. That device comprises a securing hook for securing the latch, a coin return path, and a coin-receiving mechanism defining a slot for receiving coinage. The coinreceiving mechanism is movable relative to the latch between first and second positions. In the first position, an outlet of the slot is disposed in a position enabling the latch to be released upon the depositing of a preselected coinage. In the second position, the outlet of the slot overlies the coin path to enable deposited coins to fall through the slots and onto the coin return path. A coin return actuator is operably connected to the coin-receiving mechanism for moving the latter from the first position to the second position.

Preferably, the coin-receiving mechanism is mounted for pivotable movement about a horizontal pivot axis, such that the outlet of the slot moves in a direction generally laterally of the direction of movement in which the latch moves when entering the housing.

The coin return path is preferably defined at least in part by a diverter. The diverter is movable between a coin return position and a coin retention position. The diverter is kept in the coin return position in response to the latch being fully inserted into the housing, but is moved to the coin retention position in response to the latch being moved out of the housing.

In another aspect of the present invention, a coin operated display rack includes a housing forming first and second adjacent compartments. The first compartment is adapted to contain articles, such as newspapers, to be displayed. The second compartment is closed-off by a front wall which extends between opposing sides of the second compartment. A door is mounted on the housing for exposing the first compartment, the door including a latch insertable through the front wall. A coin-operated mechanism is disposed in the second compartment for releasably securing the latch. A guide mechanism is arranged in the second compartment and defines a generally curved guide surface extending upwardly and forwardly at each side of the second compartment. The guide surfaces face generally rearwardly. A stop is disposed at an upper end of each of the guide surfaces. The front wall carries followers extending behind and slidably engaging the guide surfaces. The followers are slidable upwardly and forwardly along the guide surfaces as the wall is pivoted open forwardly about a lower edge thereof and until the followers engage the stops. At that point, the followers can be lifted upwardly and off the guide surfaces to enable the wall to be removed from the housing.

Preferably, a locking flange is anchored in the second compartment and includes a rearwardly facing locking surface. A latching member is pivotably mounted at an edge of the wall (other than the lower edge thereof). The latching member includes a portion engageable with the locking surface to prevent opening of the wall. A key actuated lock in the wall includes a rotatable arm. A connector interconnects the latching member and the arm to transmit rotary forces from the arm to the latching member for pivoting the latter to an unlocking position. A spring biases the latching member to a locking position. The connector includes a lost motion connection permitting the latching member to move relative to the arm to its locking position against the bias of the spring. A cam surface is disposed in front of the latching member for pivoting the latching member to the unlocking position until the latching member travels behind the locking surface and is pivoted to the locking position by the spring.

THE DRAWINGS

The objects and advantages of the invention will become apparent from the following detailed description of a preferred embodiment thereof in connection with the accompanying drawings in which like numerals designate like elements, and in which:

FIG. 10 is a plan view corresponding to the mechanism depicted in FIG. 7;

FIG. 11 is a plan view corresponding to the mechanism depicted in FIG. 8;

FIG. 12 is a plan view corresponding to the mechanism depicted in FIG. 9;

DETAILED DESCRIPTION OF A PREFERRED EMBODIMENT OF THE INVENTION

Figure 1:
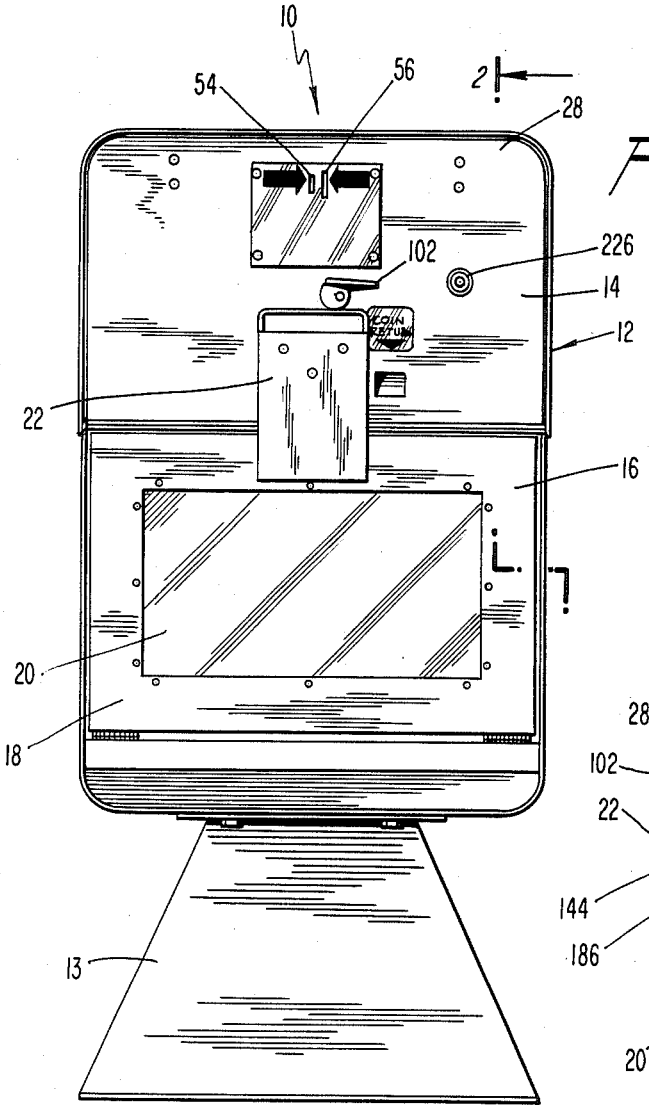
FIG. 1 is a front elevational view of a coin operated newspaper rack according to a preferred embodiment of the present invention.
Figure 2:
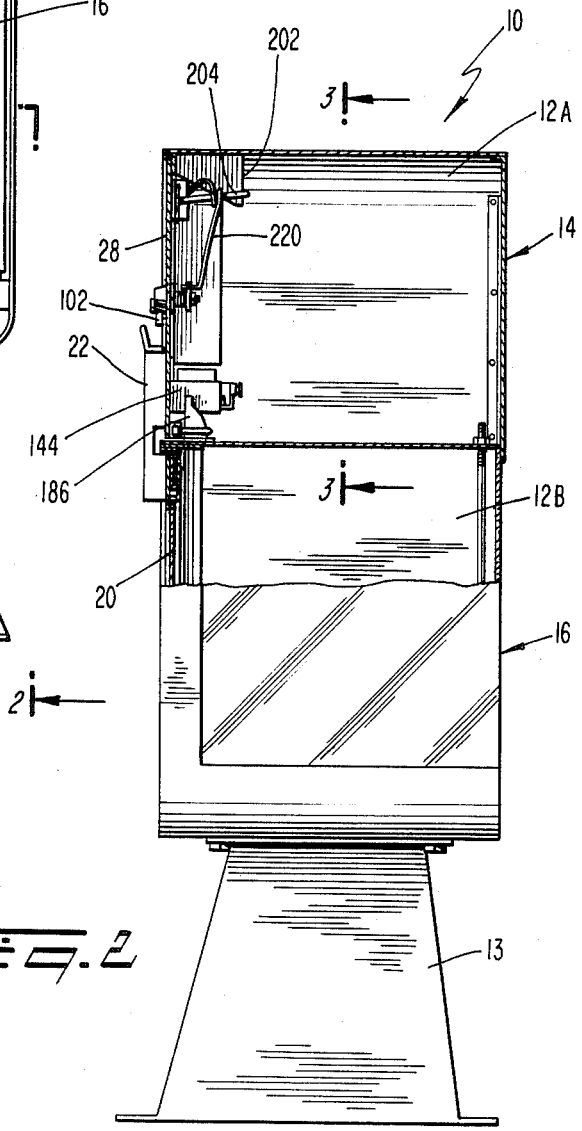
FIG. 2 is a sectional view taken along the line 2—2 in FIG. 1.

In accordance with the present invention, there is depicted in FIGS. 1 and 2 a coin-operated newspaper display machine 10. The machine 10 includes a housing 12 mounted on a pedestal 13. The housing 12 includes upper and lower compartments 12A, 12B formed in upper and lower housing parts. The lower housing part 16 includes an access door 18 which contains a transparent window 20. The door is hinged along its lower edge for rotation about a horizontal axis and is spring-biased to a closed position in conventional fashion. A flange 22 is carried by the door, the flange, in turn, carrying a latch 24 which is adapted to pass through a recess 26 (FIG. 3) in a front wall 28 of the upper housing part 14. The latch 24 is releasably held by a coin-operated mechanism which is mounted on an inside surface 30 of the wall 28, as will be explained subsequently.

The latch 24 is pivotably mounted to the door 18 for rotation about a horizontal axis so that the outer free end of the latch is movable upwardly and downwardly. A spring (not shown) biases the latch to its upward position. An aperture 32 (FIGS. 7, 10) in the latch 24 receives a projection 33 of a securing hook 34 which is fixedly mounted to a bracket 36 (FIG. 3), the bracket being affixed to the wall 28. The bracket 36 includes a vertical main part 37 attached to the wall 28 by means of bolts 38, and a horizontally projecting flange 40 at the lower end of the main part 37. The hook 34 is affixed to the flange 40 and the main part 37 such that the projection 33 of the hook enters the aperture 32 in the latch 24 when the latter is in its upward position, to prevent removal of the latch from the upper housing part 14, i.e., the door 18 is locked in its closed position.

Figure 15:
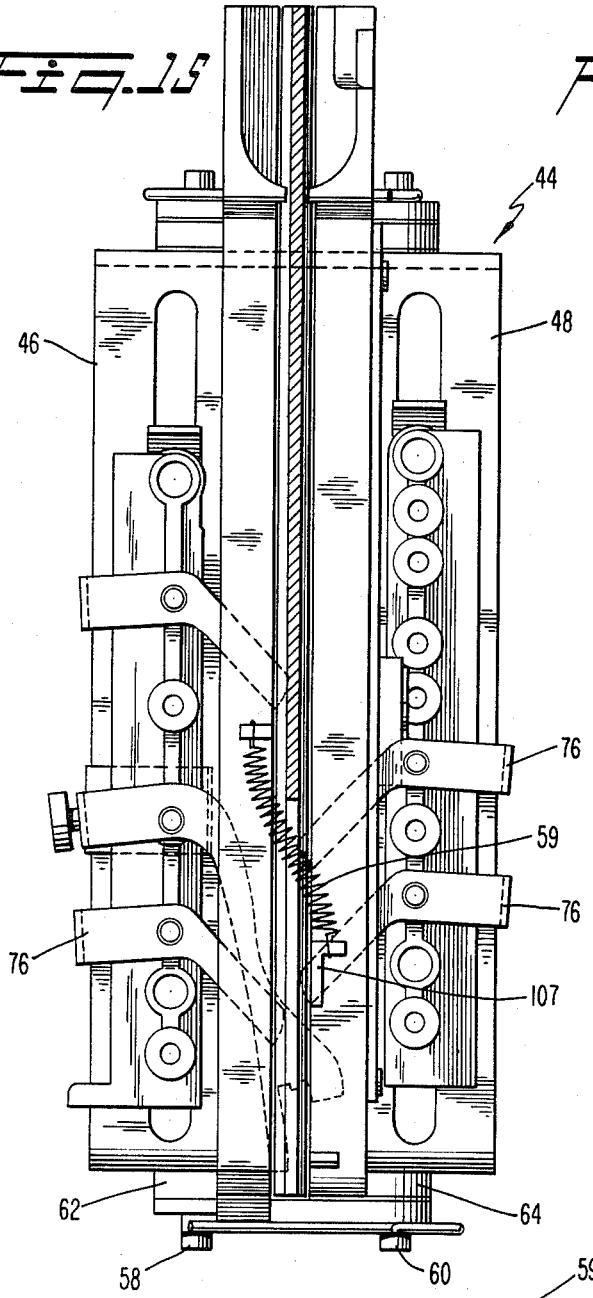
FIG. 15 is a rear view of a coin-receiving mechanism according to the present invention.
Figure 16:
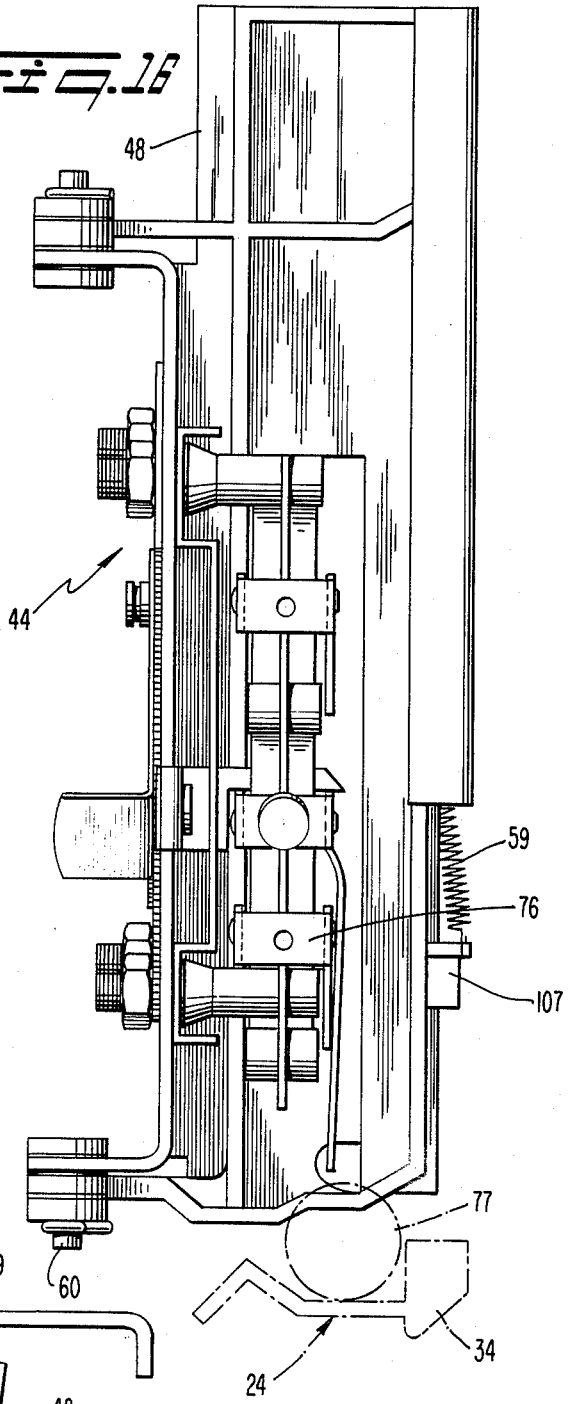
FIG. 16 is a side view of the mechanism depicted in FIG. 15.
Figure 17:
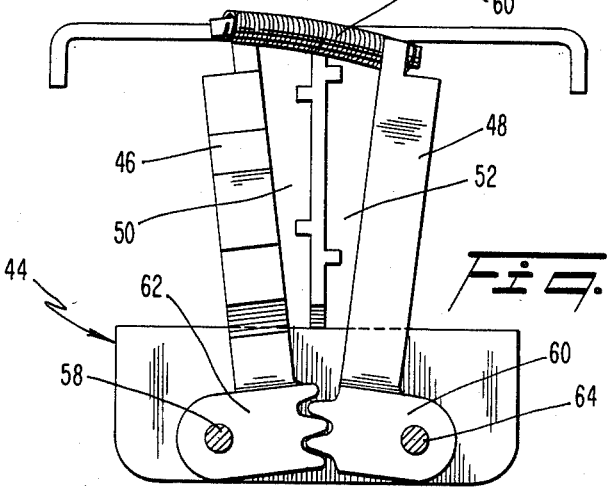
FIG. 17 is a plan view of the mechanism depicted in FIG. 15, with the channel members thereof being separated from one another to open up the coin receiving slots.

The latch 24 also includes a cam surface 42 (FIGS. 1 and 7) which projects upwardly by a distance greater than the distance which the hook projection 33 extends below the opening 32 to enable the cam surface to cam the latch downwardly sufficiently to disengage the hook from the opening 32, as will be explained subsequently. Mounted on the plate 36 above the latch 24 is a coin-receiving mechanism 44 (FIGS. 15–17). That mechanism 44 is preferably substantially the same as that disclosed in U.S. Pat. No. 4,371,072, so no detailed description thereof is required herein. The disclosure of U.S. Pat. No. 4,371,072 is incorporated herein by reference. Basically, that mechanism includes a pair of channel members 46, 48 which define vertical coin slots 50, 52 (see FIG. 17 which depicts the channel members in a mutually separated state whereby the slots 50, 52 are opened up). The upper ends of the slots 50, 52 are aligned with coin slits 54, 56 (FIGS. 1, 3) formed in the wall 28 of the upper housing part 14. The channel members 46, 48 are mutually rotatable about vertical pivot pins 58, 60 against the bias of a spring 59 and are interconnected by means of toothed coupling elements 62, 64 (FIG. 17). Thus, rotation of either channel member about its vertical pivot pin causes the other channel member to rotate as well, whereby the channel members 46, 48 are caused to separate, and the slots 50, 52 are opened up.

It will be appreciated that coins deposited within the slots 54, 56 will fall downwardly until coming to rest upon the cam surface 42 of the latch 24 or upon another coin. When the proper prescribed coinage has been deposited, upward movement of the coins is prevented by pawls 76 as described in the afore-mentioned U.S. Pat. No. 4,371,072. Therefore, if the door 18, and thus the latch 24, is pulled outwardly, the lowermost coin(s) 77 contacting the cam surface 42 will cause the latch to be swung downwardly, until the opening 32 passes clear of the hook projection 33. This releases the latch and enables the door 18 to be swung open.

The apparatus as heretofore described is basically similar to that descirbed in the afore-mentioned U.S. Pat. No. 4,371,072. In the mechanism described in that patent, however, actuation of a coin-return actuator caused (a) the latch to be shifted sidewardly, (b) a coin-return chute to be moved beneath the coins, and (c) the channel members to be swung apart to open-up the slots. Some of the consequences of that combination of steps have been discussed earlier herein in the Background section.

Figure 14:
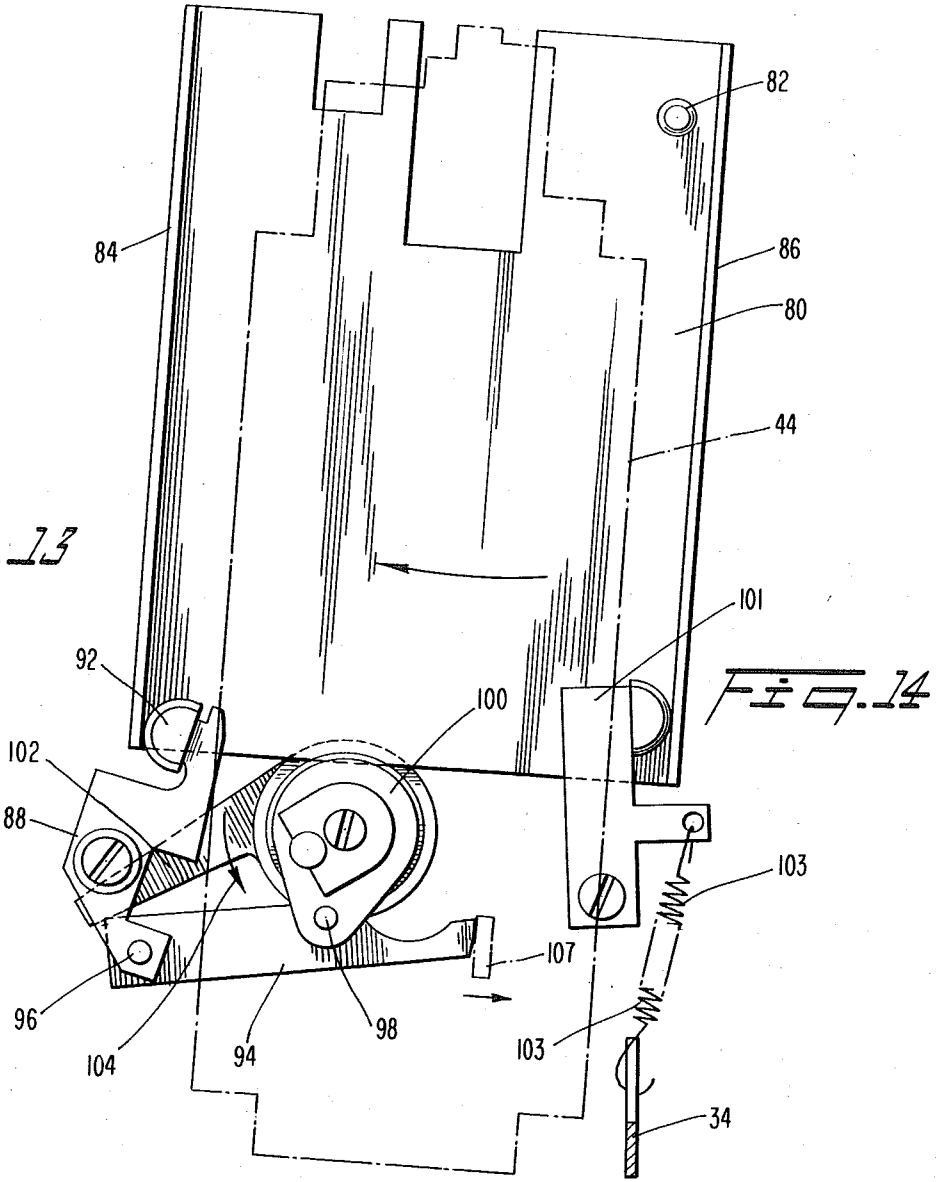
FIG. 14 is a view similar to FIG. 13 after the coin return actuator has been actuated to pivot the coin-receiving mechanism to a coin return position.
Figure 13:
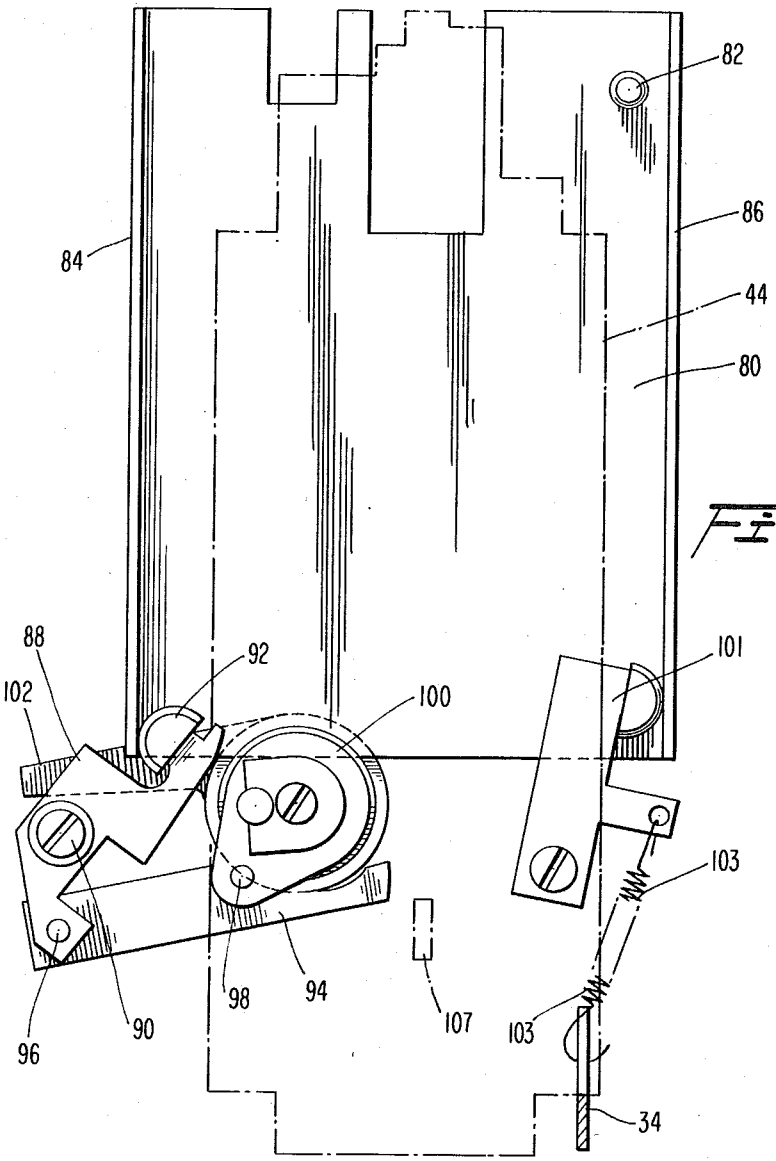
FIG. 13 is a rear view of the coin-operated mechanism, with a coin-receiving mechanism thereof depicted in phantom lines and in a coin-retention position.

In accordance with the present invention, actuation of a coin-return actuator causes deposited coins to be returned without requiring either sideward shifting of the latch or movement of a coin-return diverter. In that regard, attention is directed to FIGS. 3 and 13 which depict the coin-receiving mechanism 44 as being secured in any suitable manner to a base plate 80. The base plate 80 is mounted on the bracket 36 for swinging movement relative to the bracket about a pivot pin 82 located at one of the upper corners of the base plate 80 (i.e., the upper right-hand corner as viewed in FIG. 3). The base plate 80 is bent at its vertical sides to form a pair of flanges 84, 86. Arranged to bear against one of the flanges 84 is a lever arm 88 which is rotatably mounted to the wall 28 by a pivot 90. One end of the lever arm 88 carries a flexible cap 92 (e.g., rubber or plastic) which bears against the flange 84. The other end of the lever arm 88, located on the opposite side of the pivot 90, is connected to a bar 94 by a pivot 96. Connected to the bar 94 by means of a pivot 98 is a rotary shaft 100. The shaft 100 is rotatably mounted within the wall 28 and is fixedly secured to an end of a coin-return actuator in the form of a handle 102 located on the outside surface of the wall 28. By pushing downwardly upon the actuator 102, the lever arm is caused to rotate in a direction 104 (counterclockwise as viewed in FIG. 14) causing the base plate 80 and the coin-receiving mechanism 44 to pivot about the pin 82 in a direction 106 whereby the lower outlet ends of the slots no longer lie above the cam surface 42 of the latch 24, but rather are disposed laterally of the latch (see FIG. 8). Accordingly, any coins disposed within the slots will drop from the outlets of the slots.

Pivotably mounted on the base plate 80 is an arm 101 (FIG. 13) to which is connected one end of a coil tension spring 103. The other end of the spring is attached to the hook 34. The spring-biased arm 101 urges the base plate 80 to a position in which the base plate engages a stop 105 (FIG. 3), mounted on the bracket 36 adjacent the pin 82. This defines the normal at-rest position of the base plate 80 and the coin-receiving mechanism 44. The stop is flexible and includes a lip 105A which overlies the coin-receiving mechanism. The stop 105 can be flexed away from the mechanism 44 to enable the latter to be removed.

The coin-receiving mechanism 44 includes an abutment 107 (FIGS. 13, 16) carried by the channel member 48. The abutment 107 is adapted to be engaged and pushed by the bar 94 when the coin-return actuator 102 is depressed, in order to open up the slots 50, 52 of the coin-receiving mechanism. That is, as the shaft 100 rotates in a coinrelease direction, i.e., counterclockwise as viewed in FIGS. 13 and 14, the bar is displaced toward the abutment 107, even as the abutment 107 is approaching the bar (since rotation of the shaft 100 causes the base plate 80 and the coinreceiving mechanism to be rotated). As the bar 94 pushes against the abutment 107, the channel member 48 is swung about its pivot 60, producing rotation of the other channel member 46 to open-up the slots 50, 52. Thus, any coins which may be stuck in the slots 50, 52 will be induced to drop out.

Figure 3:
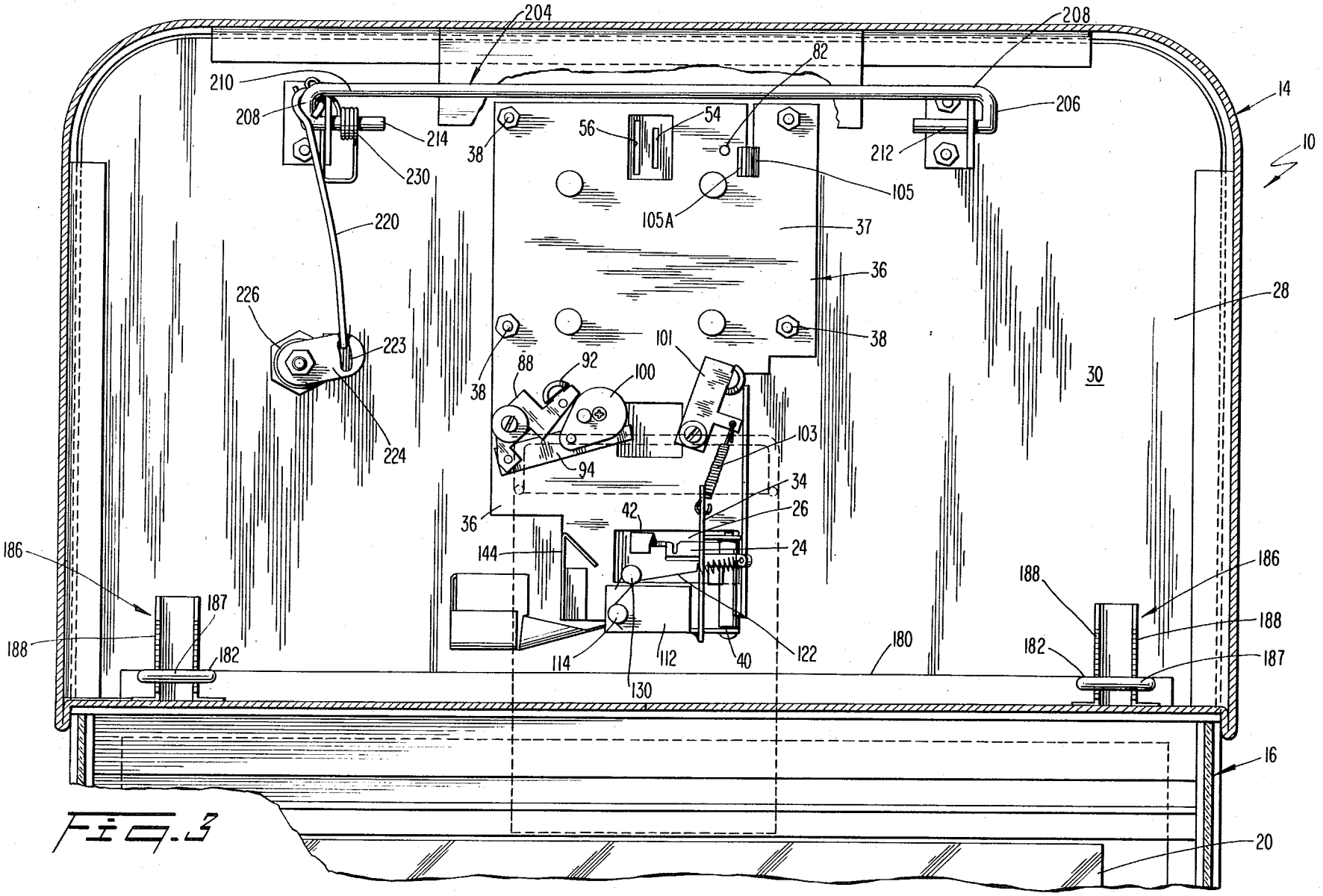
FIG. 3 is a sectional view taken along the line 3—3 in FIG. 2.

Disposed below the latch 24 is a chute 110 which is pivoted at its lower end to an upstanding wall 112 of the bracket 36 (FIGS. 3, 12). In that regard, a pin 114 of the diverter extends through the wall 112. The diverter 110 includes a pair of curved opposing side surfaces 116, 118 which converge in an upward direction toward an upper edge 120 of the diverter. The diverter is rotatable between a coin-return position wherein the edge 120 of the diverter is located beneath the latch 24 (FIGS. 7, 8, 10, 11), and a coin-retention position (FIGS. 9, 12) in which the edge 120 is displaced relative to the latch 24 in the same direction that the lower end of the coin-receiving mechanism 44 rotates when actuated by the coin-release mechanism. Rotation of the diverter between those two positions is controlled by a spring 122 and a lever 124. The lever 124 is mounted for rotation about a vertical axis by means of an axle 126 mounted on the bracket 36. The lever 124 includes a first end 127 to which one end 128 of the spring 122 is connected. The spring 122, in the form of a coil tension spring, has its other end 131 wrapped firstly around an extension 130 of the upper end of the diverter 110, and then around the pivot pin 114, the arrangement being such that the spring 122 inherently tends to bias the diverter to a coin-retention position (FIGS. 9, 12), while biasing the lever 124 to a position depicted in FIGS. 9, 12. In that position of the lever 124, a second end 132 of the lever is arranged to be contacted by the latch 24 (FIG. 10) and be pivoted in a direction 134 tending to displace the spring 122 and thereby pivot the diverter 110 to a coin-return position (FIG. 7) when the door 18 is closed. When the door 18 is opened, the spring 122 biases the diverter 110 to a coin-return position and swings the lever 124 in a direction opposite the arrow 134. Thus, while the door 18 is closed, the diverter 110 is maintained in a coin-return position independently of actuation of the coin-return actuator 102, the latter never exerting influence over the position of the diverter 110.

Figure 7:
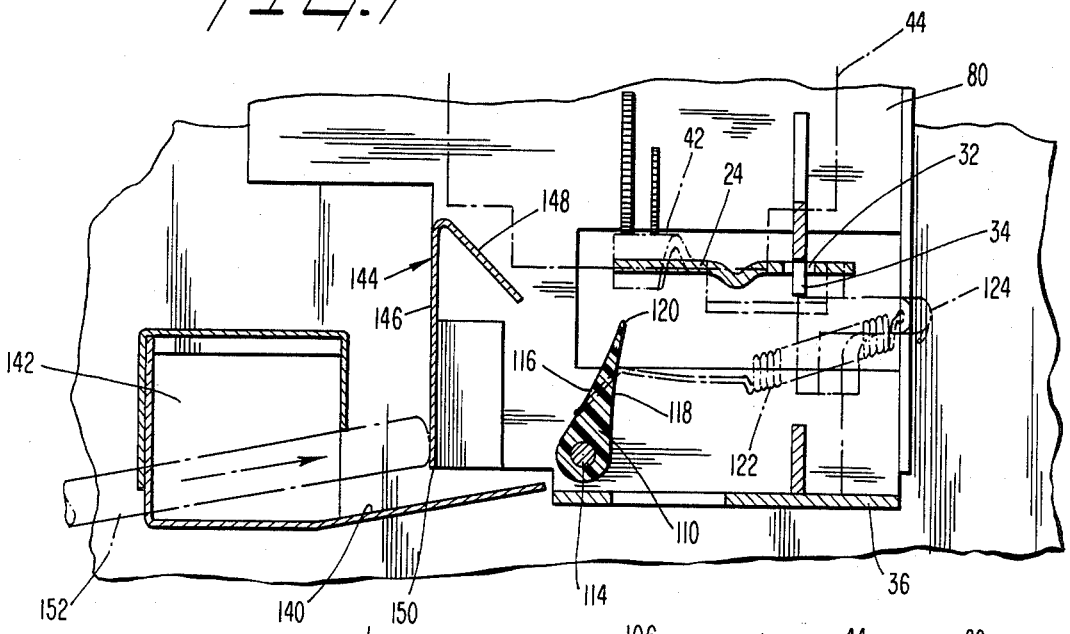
FIG. 7 is a rear view of a coin guiding diverter in a coin return position, a latch of the door being depicted in phantom lines.

When the diverter 110 is in a coin-return position, the coin-return surface 116 thereof leads downwardly towards a coin return ramp 140. The surface 116 and ramp 140 thus define a coin-return path. The ramp 140 is inclined downwardly to an opening 142 in the wall 28, whereby coins falling from the coin-receiving mechanism will be directed to such opening 142. Situated above the ramp 140 is a guard plate 144 (FIG. 7) which includes a vertical portion 146 and a downwardly inclined portion 148. The lower edge 150 of the portion 146 is spaced sufficiently above the ramp 140 to enable coins to slide along the ramp beneath the edge 150. The guard plate 144 prevents the machine from being cheated by the insertion of an object such as a stick 152 (FIG. 7) through the coin return opening 142 and against the diverter 110 to hold the diverter to a coin-return position even after the door has been opened. That is, such a stick would, instead, abut the guard plate 144 and be unable to reach the chute 110 as depicted in FIG. 7.

In accordance with the present invention, the wall 28 is arranged to be easily opened and closed, as well as to be completely removed to facilitate maintenance. In that regard, the wall 28 has a bar 180 affixed along its lower edge (FIGS. 3 and 4), and a pair of U-shaped followers or brackets 182 are affixed to opposite ends of the bar so as to project horizontally therefrom. Each bracket 182 includes a pair of legs 185 and a bight 187 interconnecting the legs. Affixed to a floor plate 184 within the housing are a pair of upstanding hinge plates 186 around which the brackets 182 extend. Each hinge plate 186 includes a pair of guide edges 188 against which the respective bight 187 engages. Those edges 188 are curved upwardly and forwardly about a center defined by the line contact 190 between the lower edge of the wall 28 and the floor plate 184. Thus, as the wall 28 is pivoted about such a line 190, the guide edges 188 guide the rotary movement of the wall 28. The upper ends of the guide edges 188 terminate in vertical stop edges 192 to limit the movement of the wall. If it is desired to completely remove the wall, as for repair or maintenance, the wall 28 is first swung open and then moved vertically so that the brackets 182 pass upwardly beyond the stop surfaces 192. To install the wall, those steps are performed in reverse sequence.

To lock the wall 28 in place, a latching mechanism 200 (FIGS. 3, 4) is mounted on the wall for engaging a rearwardly facing locking surface 202 of a locking flange 201 mounted on the housing 12. The latching mechanism 200 includes a generally U-shaped latching member 204 which has a pair of legs 206, 208 interconnected by a bight 210. The legs 206, 208 each terminate in bent ends 212, 214 which are rotatably mounted in brackets 216 carried by the wall 28. Thus, the latching member 204 is rotatable about a horizontal axis disposed parallel to the bight 210, the axis defined by the bent ends 212, 214.

Figure 4:
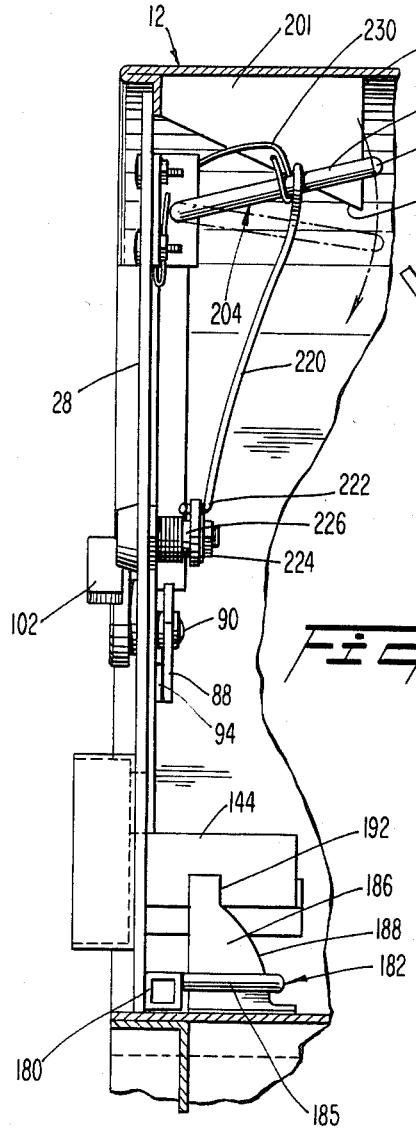
FIG. 4 is a side elevational view of a mounting arrangement for a front wall of the housing.

Mounted on the leg 208 is an end 218 of a rod 220 (FIG. 4). The other end 222 of the rod 220 is mounted in a slot 223 of an ear 224. The ear is connected to a key cylinder 226 so as to be rotatable by means of a key inserted into a keyhole from outside the wall 28. When the key is turned in an unlocking direction 228 (FIG. 6), the latch member 204 is swung downwardly to disengage the bight 210 from the flange 202. In that manner, the wall can be swung open.

A spring 230 biases the latch member 204 upwardly to its locking position. The ear 224 will also be biased upwardly since the latching member 204 and the ear 224 are interconnected. Hence, when the key is removed from the lock, the latching member 204 and ear 224 will be swung upwardly by the spring 230.

Figure 6:
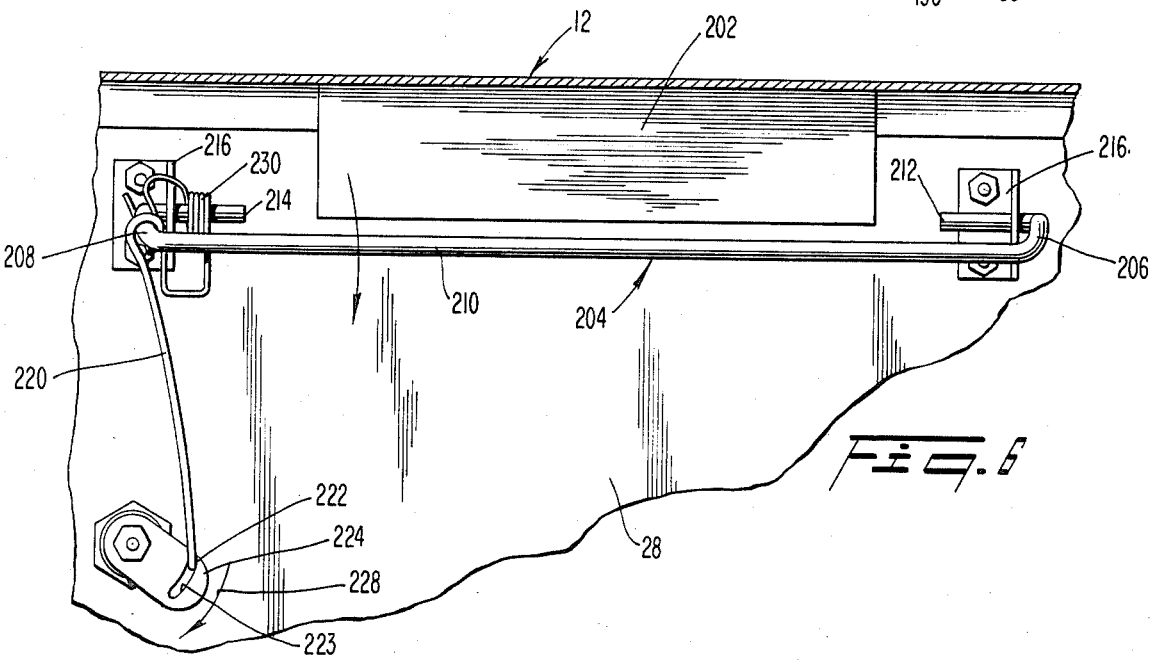
FIG. 6 is a rear view of the latching arrangement depicted in FIG. 4.

Located in front of the vertical flange 202 are a pair of inclined cam edges 232 against which the bight 210 will engage when the wall is being closed. Hence, the cam edges 232 will pivot the locking member downwardly so that the bight 210 can pass behind the flange 202. Thereafter, the spring 230 will swing the latching member 204 upwardly to lock the wall. That downward movement of the latching member is permitted since the lower end 222 of the rod 220 is mounted in a lost-motion manner within the slot 223. That is, the rod 220 is free to move relative to the ear 224 within limits defined by the slot 223 (FIG. 6). As a result, the wall automatically locks when closed.

It will be appreciated from the foregoing that the wall 28 can be key opened, whereupon the operator can remove the key and then later effect a closing and locking of the door without having to retrieve the key.

Figure 9:
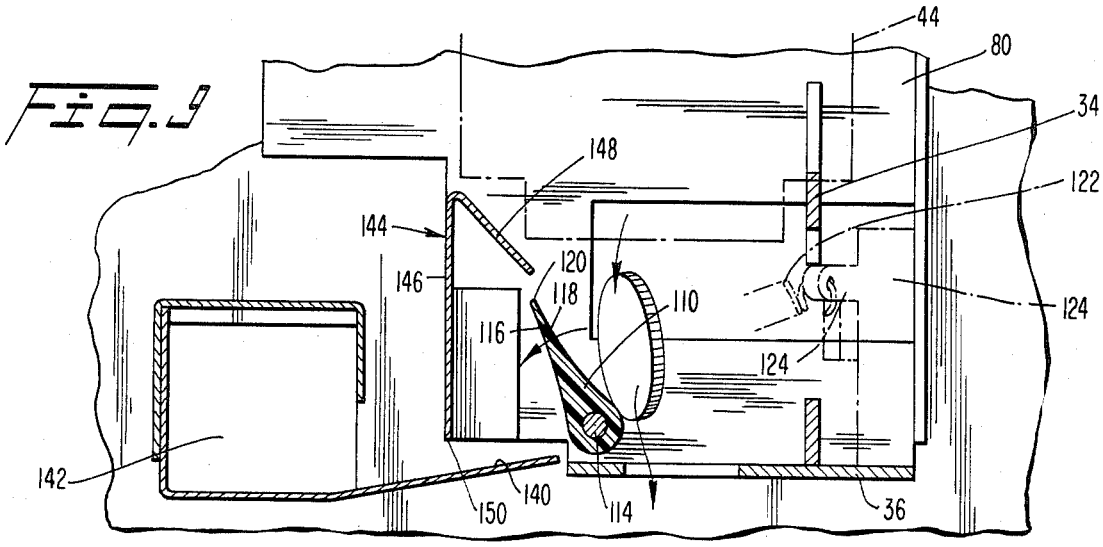
FIG. 9 is a view similar to FIG. 7 with the coin return diverter disposed in a coin retention position.

In operation, the coin diverter 110 is normally held in a coin return position (FIGS. 7 and 10) by the engagement of the latch 24 with the lever 124. When a customer purchases a newspaper or the like, coins are deposited into the slot(s) of the coin-receiving mechanism 44 and come to rest on the cam surface 42 of the latch 24. Thereafter, when the door 18 is pulled open, the latch 24 is disengaged from the lever 124, and the spring 122 pivots the coin diverter 110 to a coin retention position as depicted in FIGS. 9 and 12. As soon as the latch has been removed from the housing, the coins are no longer supported and will drop against the diverter 110 and be deflected toward a coin collection box.

Figure 8:
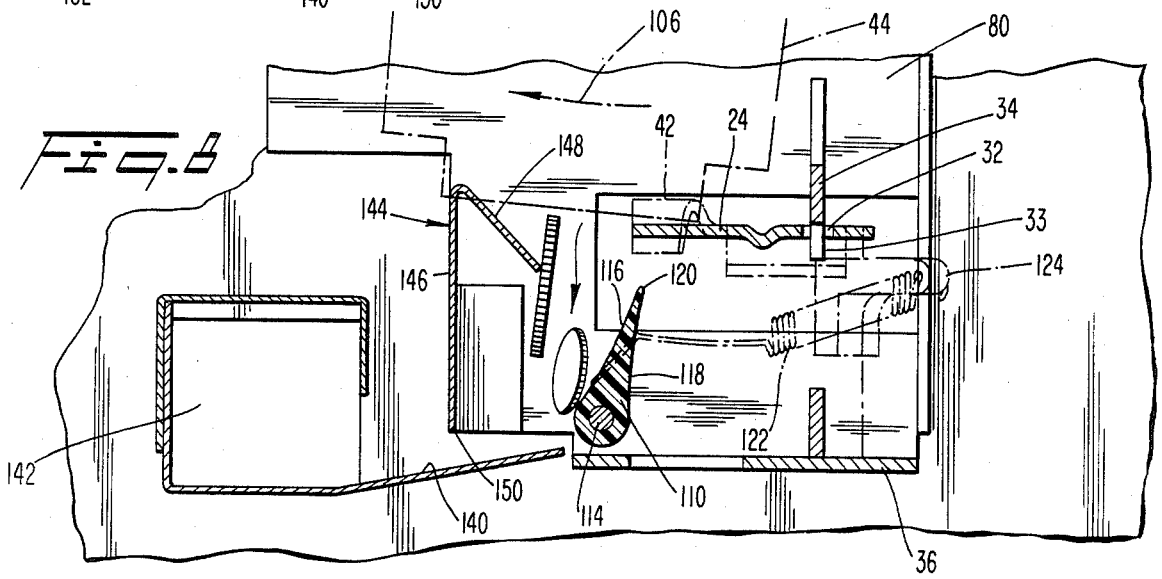
FIG. 8 is a view similar to FIG. 7 after a coin-receiving mechanism (depicted in phantom lines) has been moved to a coin return position and the coins are in the process of traveling to a coin return slot.

If, after the coins have been deposited, and before the door 18 is opened, the customer desires that the coins be returned, the coin return lever 102 (FIG. 13) is depressed. As a result, the lever arm 88 is pivoted (counterclockwise as viewed in FIG. 13) so as to pivot the base plate 80 and the coin-return mechanism 44 (in a clockwise direction as viewed in FIG. 14). As a result, the lower end of the coinreturn mechanism 44, and thus the lower end of the slots 50,52 therein, are moved laterally out of overlying relationship with the cam surface 42 of the latch 24 as depicted in FIGS. 8 and 11. When this occurs, the coins will fall from the slots 50, 52 and onto the diverter 110 which deflects the coins to the coin return ramp 140. Simultaneously, the bar 94 is moved into engagement with the projection 107 of the channel-forming member 48, whereby the channel forming members 46, 48 are pivoted away from one another to open up the slots 50, 52. This aids in releasing any coins which might be jammed within the slots.

Figure 5:
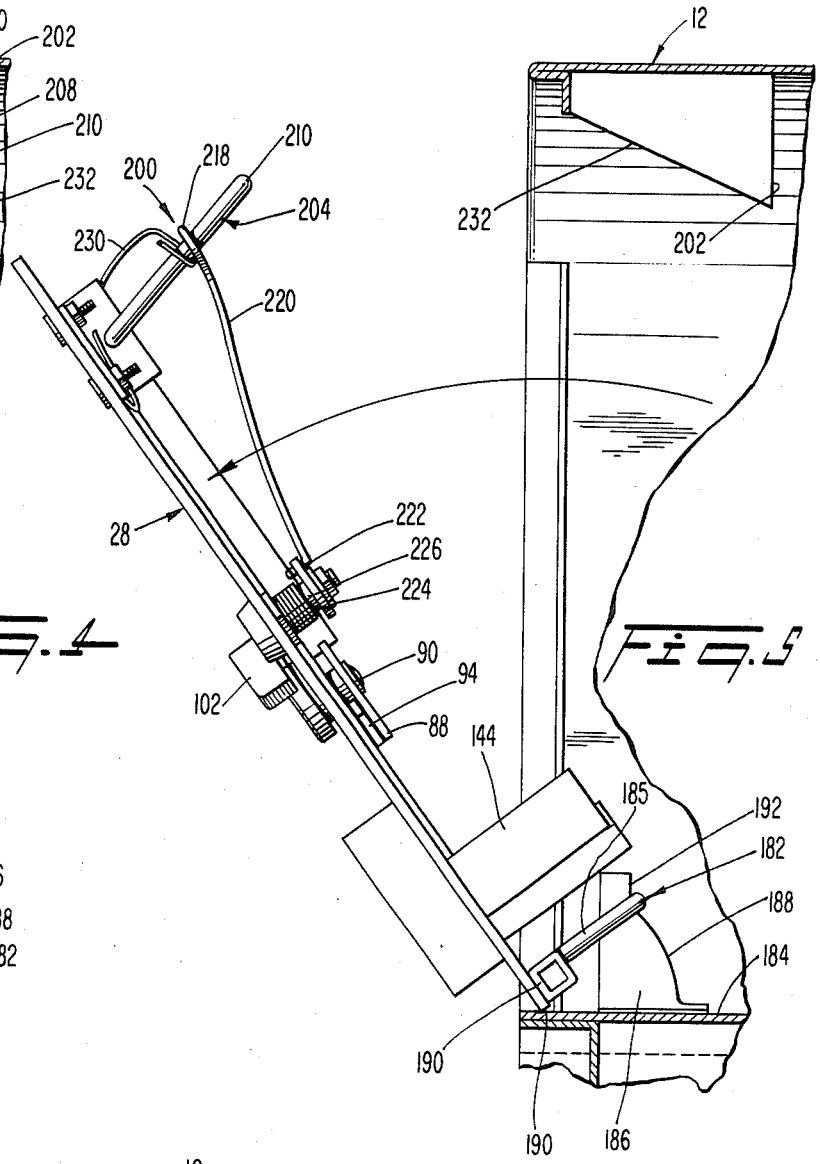
FIG. 5 is a view similar to FIG. 4, depicting the front wall in an open position and capable of being removed from the housing.

When it is desired to open the front wall 28 to gain access to the coin collection box and/or the coin-receiving mechanism, a key is inserted into the key cylinder 226 (FIG. 4) and the ear 224 is rotated, along with the connector 220, in order to swing the latch member 204 downwardly and out of engagement with the locking surface 202. This enables the door to be swung to an open position as depicted in FIG. 5, while the U-shaped brackets 182 ride along the curved guide surfaces 188. When the brackets engage the stop surfaces 192, rotation of the wall is terminated. In that position, it is possible to remove the wall from the housing by simply lifting the door and disengaging the brackets 182 from the stop surfaces 192.

When the front wall 28 is thereafter swung to a closed position, the latching member 204 engages the camming surface 232 whereby the latching member 204 is pivoted downwardly until the bight portion 210 thereof passes the locking surface 202, whereupon the spring 230 biases the latching member upwardly and into engagement with the locking surface 202. This action is permitted by the lost motion connection 223 between the connector 220 and the ear 224.

It will be appreciated that in accordance with the present invention, actuation of the coin-return mechanism can be accomplished with minimal resistance. That is, actuation of the coin-return mechanism does not produce movement of the coin diverter 110 or the latch 24. Furthermore, since the diverter 110 is normally maintained in a coin-return position, there is less likelihood that the mechanism can be "cheated" by a dishonest customer. Furthermore, since the latch 24 is not shifted laterally by the coin-return mechanism, there is no danger that the latch will become excessively torqued and thereby bent.

The mounting of the front wall 28 by means of the brackets 182 which slide upon guide surfaces 188, enables the wall to be easily lifted and removed from the housing if desired.

The latching member 204 can be automatically maneuvered to a locking position upon closing of the door 128 due to the lost motion connection 223 as well as the camming surface 232. As a result, it is not necessary for the operator to actuate the key cylinder 226 when closing the front wall 228.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A coin-operated display rack, comprising:

a housing for containing articles to be displayed, a door on said housing, said door including a latch receivable within said housing, coin-operated means in said housing for releasably locking said latch and comprising:

securing means securing said latch in said housing, means defining a coin-return path, a coin receiving mechanism defining slot means for receiving coinage, said coin-receiving mechanism being movable relative to said latch between a first position in which an outlet of said slot means is disposed in a position enabling said latch to be released upon the depositing of a preselected coinage, and a second position wherein said outlet overlies said coin return path to enable deposited coins to fall through said slot means and onto said coin return path, and coin return actuator means operably connected to said coin-receiving mechanism for displacing the latter from said first position to said second position, coin retaining means in said housing, said means which defines a coin-return path including a diverter situated below said latch such that coins from said coin-receiving mechanism fall upon said diverter, said diverter being movable between a coin-return position wherein said diverter diverts coins to said coin return path and a coin-retention position wherein said diverter diverts coins to said coin-retaining means, diverter displacement means provided for maintaining said diverter in said coin return position in response to said latch being fully inserted into said housing, and for moving said diverter to said coin-retention position in response to said latch being moved out of said housing.

2. A coin-operated display machine according to claim 1, wherein said securing means comprises a hook receivable in an aperture of said latch, said latch including a camming surface upon which coinage in said slot means are supported when said coin-receiving mechanism is in said first position, said latch being displaceable by the coinage to disengage said hook from said aperture in response to movement of said door toward an opened position, said outlet of said slot means being shifted to a position non-overlying said latch when said coin-receiving mechanism is in said second position.

3. A coin-operated display machine according to claim 1, wherein said coin-receiving mechanism is mounted for pivotal movement about a horizontal pivot axis, such that said outlet of said slot means moves in a direction generally laterally of the direction in which the latch moves when entering said housing.

4. A coin-operated display machine according to claim 1 wherein said diverter displacement means maintains said diverter in said coin-return position in response to said door and latch being in a closed position and moves said diverter to said coin-retaining position in response to said door and latch being in an opened position.

5. A coin-operated display machine according to claim 4, wherein said coin-receiving mechanism is pivotable about a pivot axis so as to be movable between said first and second positions, said diverter being pivotably mounted for movement about a rotary axis extending parallel to said pivot axis of said coin-receiving mechanism.

6. A coin-operated display machine according to claim 5, wherein said diverter displacement means comprises a lever arranged to be engaged and displaced by said latch when said door is in a closed position, and spring means interconnecting said lever and said diverter for biasing said diverter toward its coin-retention position, said latch transmitting forces through said spring means to said diverter to pivot said diverter to its coin-return position when said door is in a closed position.

7. A coin-operated display machine according to claim 1, wherein said housing includes a coinreturn opening at the end of the coin-return path, and a guard plate disposed between said coinreturn opening and said diverter to prevent said diverter from being displaced by an object inserted through said opening.

8. A coin-operated display rack, comprising:

a housing for containing articles to be displayed, a door on said housing, said door including a latch receivable within said housing, coin-operated means in said housing for releasably locking said latch and comprising:

securing means securing said latch in said housing, means defining a coin-return path, a coin-receiving mechanism defining slot means for receiving coinage, said coin-receiving mechanism being movable relative to said latch between a first position in which an outlet of said slot means is disposed in a position enabling said latch to be released upon the depositing of a preselected coinage, and a second position wherein said outlet overlies said coin return path to enable deposited coins to fall through said slot means and onto said coin return path, and coin return actuator means operably connected to said coin-receiving mechanism for displacing the latter from said first position to said second position, said housing defining a compartment in which said coin-receiving mechanism is disposed, said housing including a front wall closing said compartment, guide means anchored in said compartment and defining a generally curved guide surface extending upwardly and forwardly at each side of said compartment, said guide surfaces facing generally rearwardly, a stop disposed at an upper end of each of said guide surfaces, said wall including follower means extending behind and slidably engaging said guide surfaces, said follower means being slidable upwardly and forwardly along said guide surfaces as said wall is pivoted open forwardly about a lower edge thereof and until said follower means engages said stops, said follower means being movable upwardly off said guide surface when said wall is in an opened position to enable said wall to be removed from said housing.

9. A coin-operated display rack, comprising:

a housing for containing articles to be displayed, a door on said housing, said door including a latch receivable within said housing, coin-operated means in said housing for releasably locking said latch and comprising:

securing means securing said latch in said housing, means defining a coin-return path, a coin-receiving mechanism defining slot means for receiving coinage, said coin-receiving mechanism being movable relative to said latch between a first position in which an outlet of said slot means is disposed in a position enabling said latch to be released upon the depositing of a preselected coinage, and a second position wherein said outlet overlies said coin return path to enable deposited coins to fall through said slot means and onto said coin return path, and coin return actuator means operably connected to said coin-receiving mechanism for displacing the latter from said first position to said second position, said housing defining a compartment in which said coin-receiving mechanism is disposed, said housing including a front wall closing said compartment, a locking flange anchored in said compartment and including a rearwardly facing locking surface, a latching member pivotably mounted at an edge of said wall, said latching member including a portion engageable with said locking surface to prevent opening of said wall, a key-actuated lock in said wall including a rotatable arm, connector means interconnecting said latching member and said arm to transmit rotary forces from said arm to said latching member for pivoting the latter to an unlocking position, spring means biasing said latching member to a locking position, said connector means comprising a lost-motion connector permitting said latching member to move relative to said arm to said locking position against the bias of said spring means, and a cam surface disposed in front of said locking surface for engaging said latching member, as said wall is being closed, for pivoting said latching member to said unlocking position until said latching member travels behind said locking surface and is pivoted to said locking position by said spring.

10. A coin-operated display rack, comprising:

a housing for containing articles to be displayed, a door on said housing for exposing an interior of said housing, said door including a latch which is receivable in an opening of said housing when said door is closed, said latch being pivotable about a horizontal axis and including an aperture and a cam surface, means defining a coin-return path, means defining a coin-retaining path, coin-operated means in said housing for releasably locking said door and including:

a hook receivable in said aperture of said latch to prevent withdrawal of said latch from said housing, a coin diverter situated beneath and arranged to be contacted by coins falling from said latch, said diverter being movable between a coin-return position wherein said diverter diverts coins to said coin-return path, and a coin-retention position wherein said diverter diverts coins to said coin retention path, diverter displacement means for maintaining said diverter in said coin-return position in response to said latch being fully inserted into said housing, and for moving said diverter to said coin-retention position in response to said latch being moved out of said housing, a coin-receiving mechanism defining slot means for receiving coinage, said mechanism being pivotably mounted for movement relative to said latch between a first position in which an outlet of said slot means is positioned over said cam surface of said latch so that deposited coinage resting upon said cam surface is operable to pivot said latch downwardly in response to said door being pulled toward an opened position, and a second position in which said outlet of said slot means is positioned laterally of said latch and over said diverter, so that coinage in said slot means can fall past said latch and onto said diverter, and coin-return actuator means operably connected to said coin-receiving mechanism for pivoting the latter from said first position to said second position.

11. A coin-operated display machine according to claim 10, wherein said diverter displacement means includes a lever operably connected to said diverter and positioned to be engaged by said latch when the latter is inserted into said housing to displace said lever to cause said diverter to be moved to said coin-return position.

12. A coin-operated display machine according to claim 11 including spring means defining the connection between said lever and said diverter, said spring means arranged to return said diverter to said coin-retention position in response to removal of said latch from said housing.

13. A coin-operated display machine according to claim 10 including spring actuated means for returning said coin-receiving mechanism from said second position to said first position.

14. A coin-operated display machine according to claim 10 including a coin-return ramp extending from said diverter to a coin-return opening in said housing, and a guard plate positioned above said ramp between said coin-return opening and said diverter for preventing said diverter from being engaged by an object inserted through said coin-return opening.

15. A coin-operated display rack, comprising:

a housing forming first and second adjacent compartments, said first compartment adapted to contain articles to be displayed, said second compartment being closed off by a front wall which extends between opposing sides of said second compartment, a door mounted on said housing for exposing said first compartment, said door including a latch insertable through said front wall, a coin-operated mechanism disposed in said second compartment for releasably securing said latch from said housing, guide means anchored in said second compartment and defining a generally curved guide surface extending upwardly and forwardly at each side of said second compartment, said guide surfaces facing generally rearwardly, a stop disposed at an upper end of each of said guide surfaces, said wall including follower means extending behind and slidably engaging said guide surfaces, said follower means being slidable upwardly and forwardly along said guide surfaces as said wall is pivoted open forwardly about a lower edge thereof and until said follower means engages said stops, said follower means being movable freely upwardly and off said guide surfaces when said wall is in an opened position to enable said wall to be removed from said housing.

16. A coin-operated display machine according to claim 15, wherein said follower means comprises a pair of U-shaped members extending around respective ones of said guide surfaces.

17. A coin-operated display machine according to claim 15 including a locking flange anchored in said second compartment and including a rearwardly facing locking surface, a latching member pivotably mounted at an edge of said wall other than said lower edge, said latching member including a portion engageable with said locking surface to prevent opening of said wall, a key-actuated lock in said wall including a rotatable arm, connection means interconnecting said latching member and said arm to transmit rotary forces from said arm to said latching member for pivoting the latter to an unlocking position, spring means biasing said latching member to a locking position, said connection means comprising a lost-motion connector permitting said latching member to move relative to said arm to said locking position against the bias of said spring, and a cam surface disposed in front of said locking surface, as said wall is being closed, for pivoting said latching member to said unlocking position until said latching member travels behind said locking surface and is pivoted to said locking position by said spring.

18. A coin-operated display machine according to claim 17, wherein said latching member is generally U-shaped, including a pair of legs interconnected by a bight, said bight defining said portion of said latching member which engages said locking surface, said arm including a slot, said connector comprising a rod one end of which is slidably mounted in said slot to define a lost-motion connection therewith.

19. A display rack comprising a housing forming a compartment closed-off by a front wall of said housing, guide means anchored in said compartment and defining a generally curved guide surface extending upwardly and forwardly at each side of said compartment, said guide surfaces facing generally rearwardly, a stop disposed at an upper end of each of said guide surfaces, said wall including follower means extending behind and slidably engaging said guide surfaces, said follower means being slidable upwardly and forwardly along said guide surfaces as said wall is pivoted open forwardly about a lower edge thereof and until said follower means engages said stops, said follower means being movable upwardly off said guide surfaces when said wall is in an opened position to enable said wall to be removed from said housing, a locking flange anchored in said compartment and including a rearwardly facing locking surface, a latching member pivotably mounted at an edge of said wall other than said lower edge, said latching member including a portion engageable with said locking surface to prevent opening of said wall, a key-actuated lock in said wall including a rotatable arm, connector means interconnecting said latching member and said arm to transmit rotary forces from said arm to said latching member for pivoting the latter to an unlocking position, spring means biasing said latching member to a locking position, said connector means comprising a lost-motion connector permitting said latching member to move relative to said arm to said locking position against the bias of said spring means, and a cam surface disposed in front of said locking surface for engaging said latching member, as said wall is being closed, for pivoting said latching member to said unlocking position until said latching member travels behind said locking surface and is pivoted to said locking position by said spring.

* * * * *